US011105162B1

(12) United States Patent
Jones, II

(10) Patent No.: US 11,105,162 B1
(45) Date of Patent: Aug. 31, 2021

(54) RADIAL/CURVED V-SHAPED GRIPPER BLOCK FOR TUBING INJECTORS

(71) Applicant: HALLIBURTON ENERGY SERVICES, INC., Houston, TX (US)

(72) Inventor: Harley W. Jones, II, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/883,460

(22) Filed: May 26, 2020

(51) Int. Cl.
*E21B 19/08* (2006.01)
*E21B 19/22* (2006.01)

(52) U.S. Cl.
CPC ..... *E21B 19/08* (2013.01); *E21B 19/22* (2013.01)

(58) Field of Classification Search
CPC ..... E21B 19/08; E21B 19/22
See application file for complete search history.

(56) References Cited

U.S. PATENT DOCUMENTS 4,336,901 A * 6/1982 Gray ..... E21B 19/22 226/173
4,735,270 A * 4/1988 Fenyvesi ..... E21B 19/22 175/113
5,853,118 A 12/1998 Avakov
6,189,609 B1 2/2001 Shaaban et al.
6,230,955 B1 * 5/2001 Parks ..... B65G 37/005 226/190
6,892,810 B2 5/2005 Austbo et al.
9,371,706 B2 * 6/2016 Gubbins ..... E21B 19/22
10,287,833 B2 5/2019 Hassard et al.
10,787,870 B1 * 9/2020 Fulks ..... E21B 19/22
2004/0188100 A1 9/2004 Austbo et al.
2014/0251637 A1 9/2014 Gubbins et al.

FOREIGN PATENT DOCUMENTS

EP 0524648 B1 11/1997
WO 2012071666 A1 6/2012

OTHER PUBLICATIONS

International Search Report and Written Opinion, PCT Application No. PCT/US2020/035541, dated Feb. 24, 2021.

* cited by examiner

*Primary Examiner* — Matthew R Buck
(74) *Attorney, Agent, or Firm* — Polsinelli PC

(57) ABSTRACT

A system for injecting a tubing into a wellbore including a length of tubing; and an injector apparatus for disposing the length of tubing within a wellbore. The injector apparatus includes a pair of gripper chains where each gripper chain has a plurality of gripper blocks coupled therewith and a block body positioned adjacent to the gripping region and configured to couple the gripper chain. Each of the gripper blocks include a gripping region having a radical/curved v-shaped gripping surface.

18 Claims, 7 Drawing Sheets

RADIAL/CURVED V-SHAPED GRIPPER BLOCK FOR TUBING INJECTORS

FIELD

The present disclosure relates to a gripper block for grippingly engaging a tubing. In particular, the present disclosure relates to a gripper block having a radial/curved v-shaped gripper surface for use with a tubing injector for disposing tubing within a wellbore.

BACKGROUND

Wellbores are drilled into the earth for a variety of purposes including tapping into hydrocarbon bearing formations to extract the hydrocarbons for use as fuel, lubricants, in chemical production, and other purposes. Injection equipment can be used in the oil and gas production industry to force tubing into vertical and horizontal wells in order to perform various operations including, but not limited to, completions, washing, circulating, production, production enhancement, cementing, inspecting, and logging. Injection equipment generally includes a gripper block which can be used to dispose a tubing having a consistent diameter downhole.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
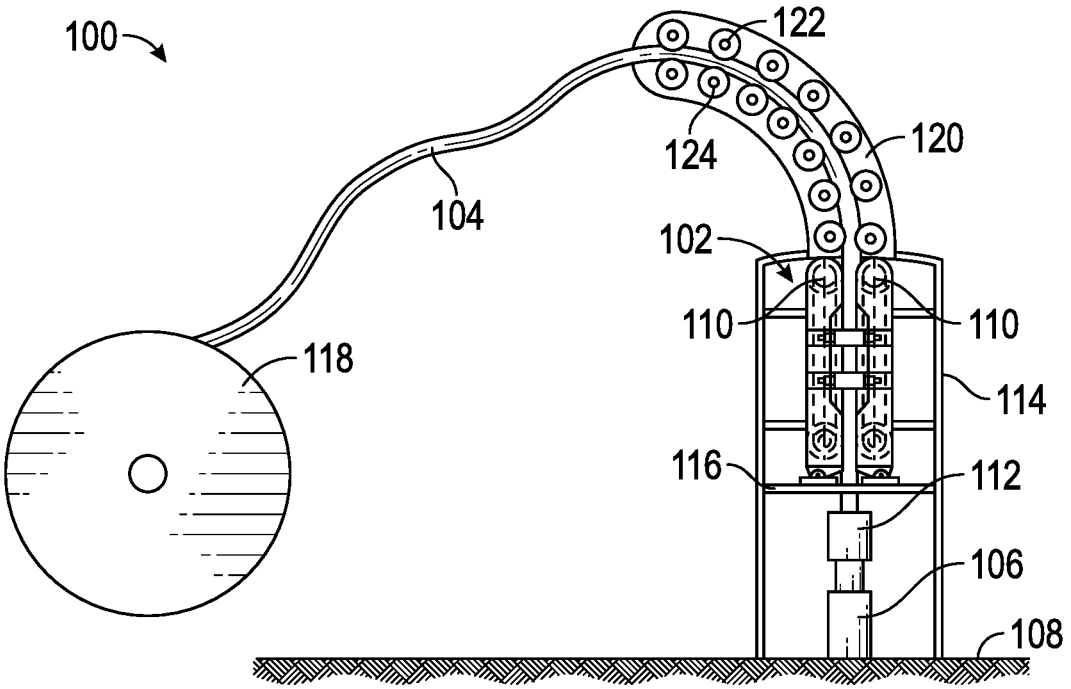
FIG. 1A is a schematic diagram of an exemplary operating environment compatible with the systems and methods as described herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiment described herein can be practiced without these specific details. In other instances, methods, procedures and components have not been described in detail so as not to obscure the related relevant feature being described herein. The drawings are not necessarily to scale and the proportions of certain parts may be exaggerated to better illustrate details and features of the present disclosure. Various embodiments of the disclosure are discussed in detail below. While specific implementations are discussed, it should be understood that this is done for illustrative purposes only. A person skilled in the relevant art will recognize that other components and configurations may be used without parting from the spirit and scope of the disclosure.

Disclosed herein is a gripper block for use with injection equipment in a wellbore system, which can include any or all of the following features or aspects in any given example. The gripper block as described herein can be used in conjunction with injection equipment for running a tubing into, and withdrawing the tubing from, a wellbore. The gripper block can include a gripper surface having a radial/curved v-shaped surface for contacting the exterior surface of a tubing string.

The gripper surface of the gripper block disclosed herein can provide a wide contact surface on the tubing string. The gripper block includes a radial/curved v-shaped profile radii which is slightly larger than the radial dimension of the tubing string being gripped, yielding wider contact with tubing string exterior surface after slight deformation of tubing string from gripping force. The gripper surface can also be made of a material that allows for slight wear, such that the gripper surface can be gradually worn down during use to increase contact area between exterior surface of tubing string and gripper surface. In addition to providing a wider contact area, the disclosed gripper block can be used with a tubing string which varies in diameter throughout the length of the sting.

The gripper block described herein can be utilized with injection equipment 102 as shown in FIG. 1A. Specifically, FIG. 1A illustrates a schematic view of an environment 100 where an injector 102 is used to dispose tubing 104 into, or remove tubing 104 from, a wellbore. As illustrated, the injector 102 is positioned above the wellhead 106 of the wellbore at a ground surface 108. A lubricator or stuffing box 112 is connected to the upper end of the wellhead 106. Tubing 104 can be supplied on a large drum or reel 118 and can be several thousand feet in length. Tubing 104 which can be used with the disclosed gripper blocks can include, but is not limited to, coiled tubing, pipe, rod, cable, or like objects having various outside dimensions. The tubing 104 can be of sufficient length to reach any desired location throughout the length of the wellbore. The injector 102 can be mounted on a superstructure 114 disposed above the wellhead 112. A tubing guide framework 120 including a plurality of guide rollers 122, 124 can be positioned above the superstructure 114 and allow the tubing 104 to enter the injector 102. The tubing 104 can be supplied by the drum 118 and run between guide rollers 122, 124 rotatably mounted on the tubing guide framework 120. The guide rollers 122, 124 assist in uncoiling the tubing 104 so that the tubing 104 is straightened when provided into the injector.

Figure 1B:
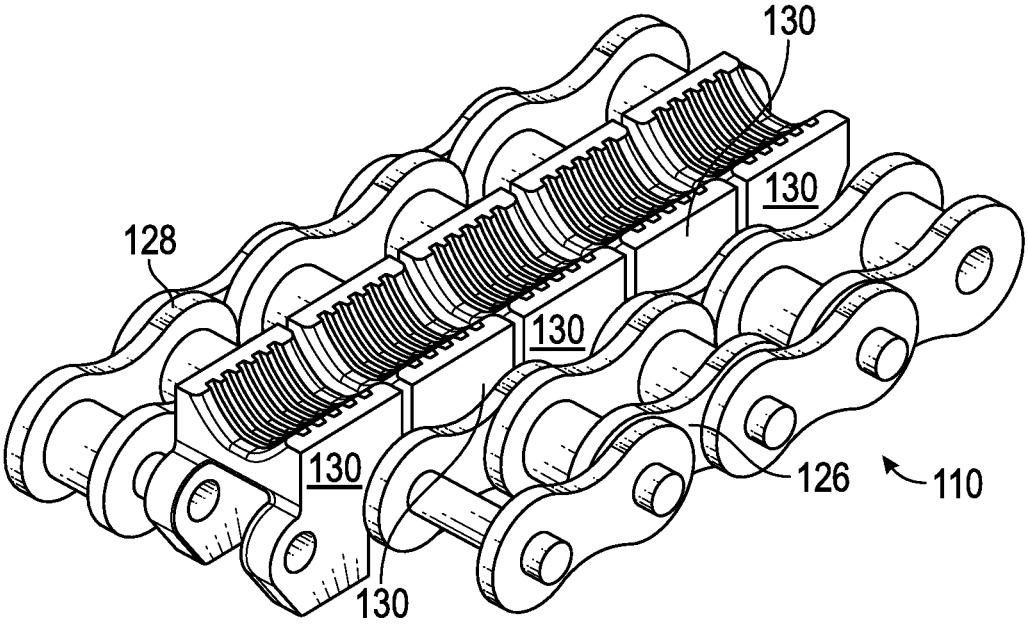
FIG. 1B is a schematic diagram of an exemplary gripper chain drive system compatible with the systems and methods as described herein.

The injector 102 can further include a base 116 with a pair of gripper chain drive systems 110. The gripper chain drive systems can include at least a plurality of links, rollers, and gripper blocks. An exemplary gripper chain drive system 110 is illustrated in FIG. 1B. As illustrated in FIG. 1B, the gripper chain drive system 110 can include parallel chains 126, 128 fitted to a plurality of gripper blocks 130. The plurality of gripper blocks 130 can be used to grippingly engaging a tubing 104 as described with respect to FIG. 1A. As used herein, the term "engage" can refer to a coupling or interlocking between two or more elements. For example, "grippingly engage" can refer to two or more elements which are coupled via a frictional force. A detailed description of the gripper block 130 is provided in FIGS. 2A-2D.

Modifications, additions, or omissions may be made to FIGS. 1A and 1B without departing from the spirit and scope of the present disclosure. For example, FIGS. 1A and 1B depict components of the wellbore operating environments in a particular configuration. However, any suitable configuration of components may be used. Furthermore, fewer components or additional components beyond those illustrated may be included in the wellbore operating environment without departing from the spirit and scope of the present disclosure. It should be noted that while FIG. 1A generally depicts a land-based operation, those skilled in the art would readily recognize that the principles described herein are equally applicable to operations that employ floating or sea-based platforms and rigs or sub-sea, without departing from the scope of the disclosure. Also, even though FIG. 1A depicts a vertical wellbore, the present disclosure is equally well-suited for use in wellbores having other orientations, including horizontal wellbores, slanted wellbores, multilateral wellbores or the like.

A gripper block for engaging a tubing string to be disposed within a wellbore, and methods and systems for using said gripper block, are presented herein. Specifically, the gripper block described herein can be coupled with a plurality of additional gripper blocks and assembled along a gripper chain to provide increased surface contact with a tubing string when disposed downhole. The gripper block and systems described herein can be increase contact between the gripper block and a tubing string reducing slippage and allowing the injector to operating with one or more tubing diameters. A cross-sectional view of an exemplary gripper block 130 as disclosed herein is shown in FIGS. 2A-D.

Figure 2A:
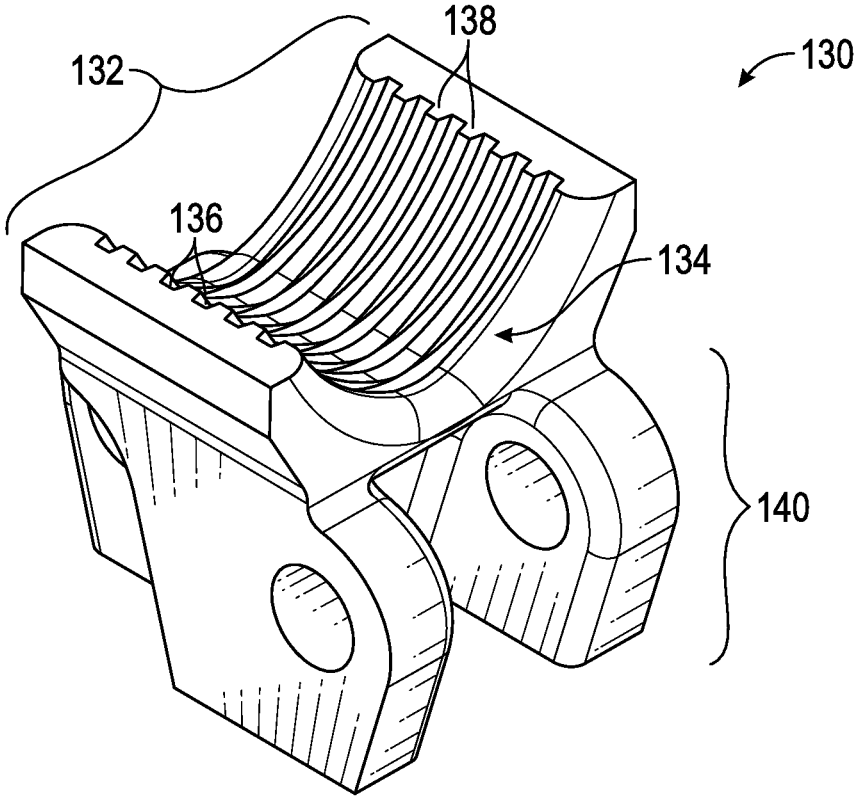
FIG. 2A is a schematic view of an exemplary radial/curved v-shaped gripper block compatible with the systems and methods disclosed herein.
Figure 2B:
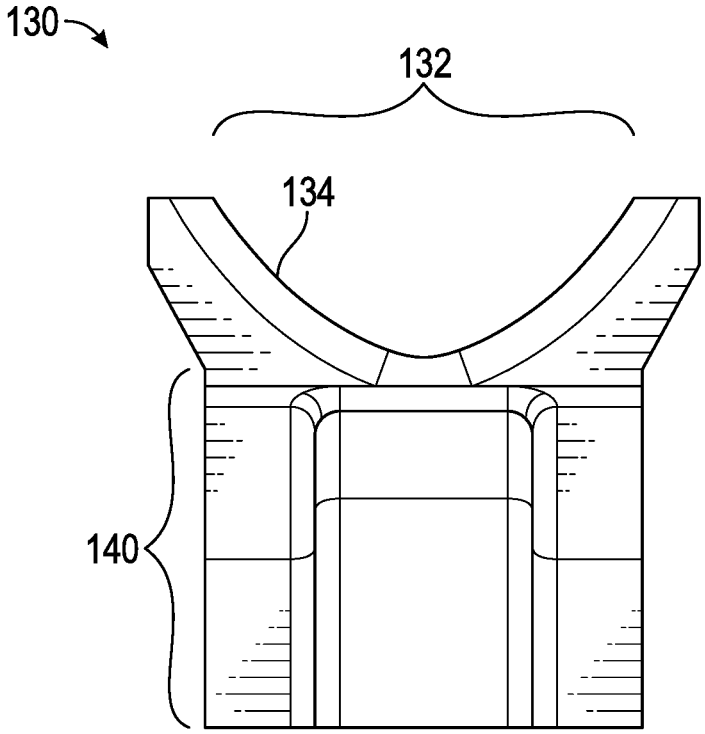
FIG. 2B is a cross-sectional view of the exemplary radial/curved v-shaped gripper block of FIG. 2A.
Figure 2C:
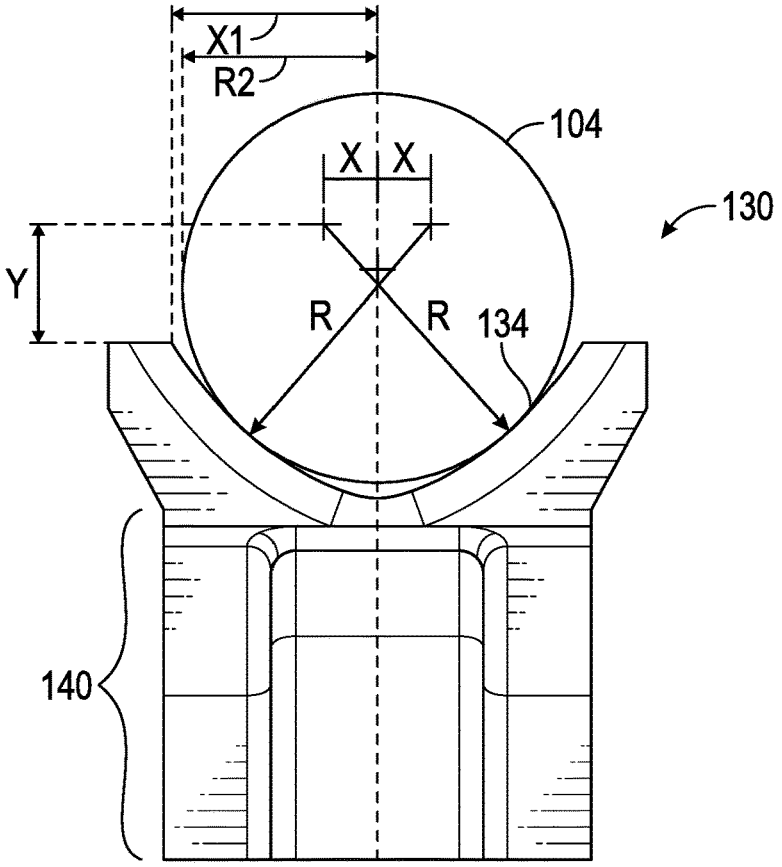
FIG. 2C is a cross-sectional view of the exemplary radial/curved v-shaped gripper block of FIG. 2A having a tubing coupled therewith.

As shown in FIG. 2A, a gripper block 130, as shown in FIG. 1B, can include a gripping region 132. The gripping region 132 can include a gripping surface 134 that is shaped to receive a tubing 104 as described with respect to FIG. 1A. As shown, the gripping region 132 can include a surface 134 which can include a plurality of grooves 136 and ridges 138 formed therein. In at least one example, the height and width of the grooves 136 and ridges 138 can be determined based on geometry used in prior flat v-shaped gripper blocks. The gripping block 130 can additionally include a block body 140 having one or more coupling regions which are capable of being coupled with a plurality of additional gripper blocks 130 to form a gripper chain as illustrated in FIG. 1B. The coupling regions of the block body 140 can be any structure suitable to couple multiple gripper blocks 130 together while remaining flexible enough to be used in the injector as described in FIG. 1A. The gripper block 130 illustrated in FIG. 2A can improve the gripping capability of current injector equipment, without the need for designing an entirely new injector. A cross-sectional view of the gripper block 130 is provided in FIG. 2B illustrating the shape of the gripping region 132 and gripping surface 134. As illustrated, the surface 134 of the gripper block 130 can have a radial/curved v-shape. The profile radii R of the present gripping region 132 can be slightly larger than the radius of the tubing 104 which is to be gripped, as illustrated in FIG. 2C. This slight increase in radius can provide a wide contact area between the gripper surface 134 and the surface of tubing 104.

Figure 2D:
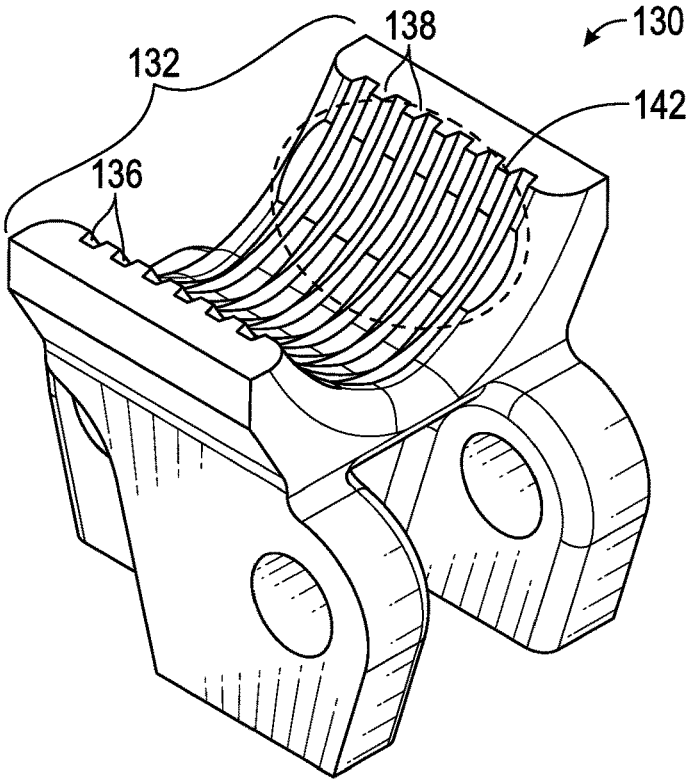
FIG. 2D is a schematic view of the exemplary radial/curved v-shaped gripper block of FIG. 2A showing wear.

FIG. 2C illustrates an exemplary gripper block 130 having the disclosed radial/curved v-shaped gripping region 132 which can receive a tubing 104. Typical gripper blocks include a flat face v-shape or a cylindrical shape gripping portion, where the cylindrical shape matches the radius of the tubing to be injected. On the contrary, the radial/curved v-shaped gripping region 132 of gripper bock 130 includes a combination of the aspects from the standard flat face v-shape gripper block and the cylindrical gripper block. The radial/curved v-shaped design provides increased contact area as compared to the flat face v-shaped gripping block but allows for flexibility between tubing sizes, which is not possible with a cylindrical shaped gripping block. The radii of the radial/curved v-shaped gripping region 132 can be determined based on the intended tubing size or sizes to be used with the gripping block 130. In at least one example, the center of profile radii R can be adjusted in X direction to make the initial contact point of tubing 104 centered in gripper surface 134. Additionally, the distance from top of gripper block 130 to center of gripping surface 134 can be adjusted in Y direction to make width X1 greater than radius R2 of the tubing 104. As illustrated, the width X1 of the gripping region 132 is greater than the radius R2 of the tubing 104, providing a wide contact area between the tubing 104 and the gripping surface 134. In at least one example, the tubing 104 can be a coiled tubing having a radius less than radius of the gripping region 132 of the gripper block 130. In at least one example, as a tubing 104 is run through a series of gripper blocks 130, the gripping force can result in slight deformation of the tubing 104 yielding a wider contact area between gripper surface 134 and tubing 104. In another example, as a tubing 104 is run through a series of gripper blocks 130 the tubing 104 can cause slight wear of gripper surface 134 yielding wider contact area with outer surface of the tubing 104. As discussed above, the gripper block 130 may be made of a material and/or surface treatment which allows for slight wear of the gripping surface 134, as such the gripper block 130 as discussed herein can be used with a tubing having various diameters throughout its length. In at least one example, the gripper block 130 can be made of steel, such as cast steel. For example, if the tubing has a first section having a first diameter and a second section having a second, larger diameter, the curved gripping surface 134 of gripping block 130 is offset from the gripper block centerline to optimize contact area over the range of tubing sizes to be utilized. FIG. 2D illustrates a schematic view of the exemplary radial/curved v-shaped griper block of FIG. 2A showing wear 142 created by the tubing 104 on the gripping region 132 of the gripper block 130. As indicated above, the wear 142 can be caused through use of the gripper block 130 with coiled tubing.

Figure 3A:
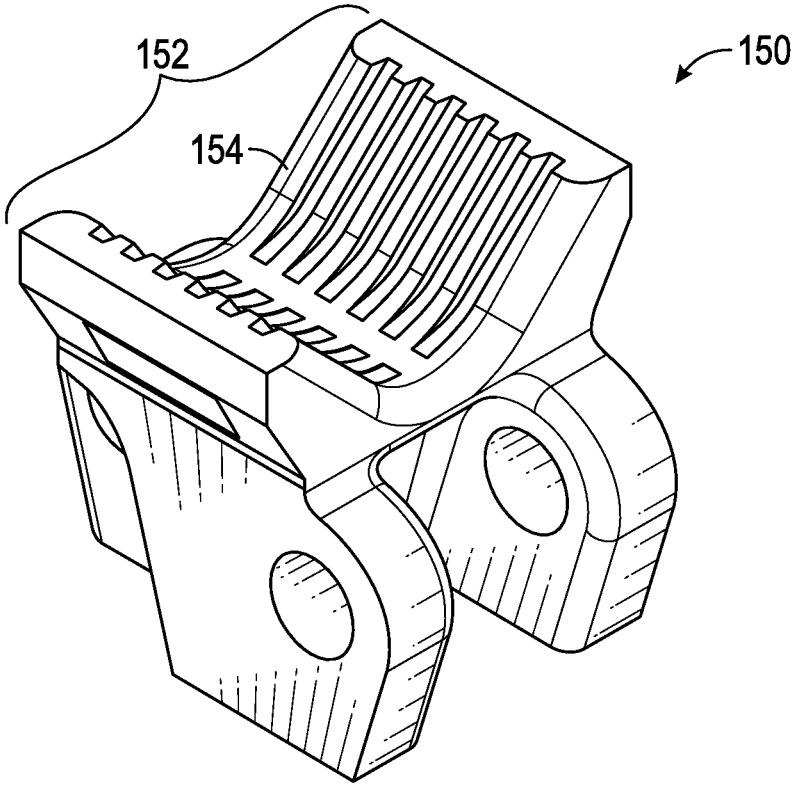
FIG. 3A is a schematic view of a flat face v-shaped gripper block.
Figure 3B:
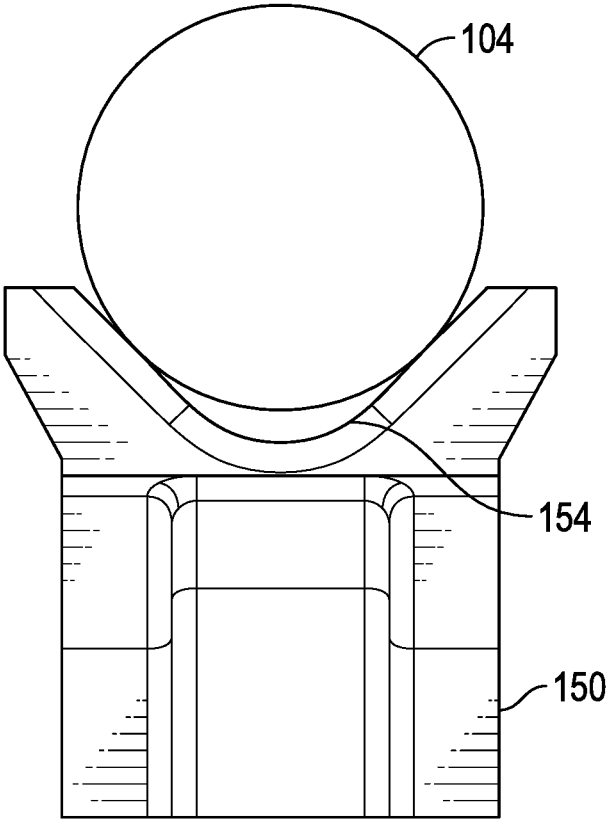
FIG. 3B is a cross-sectional view of the flat face v-shaped gripper block of FIG. 3A.
Figure 3C:
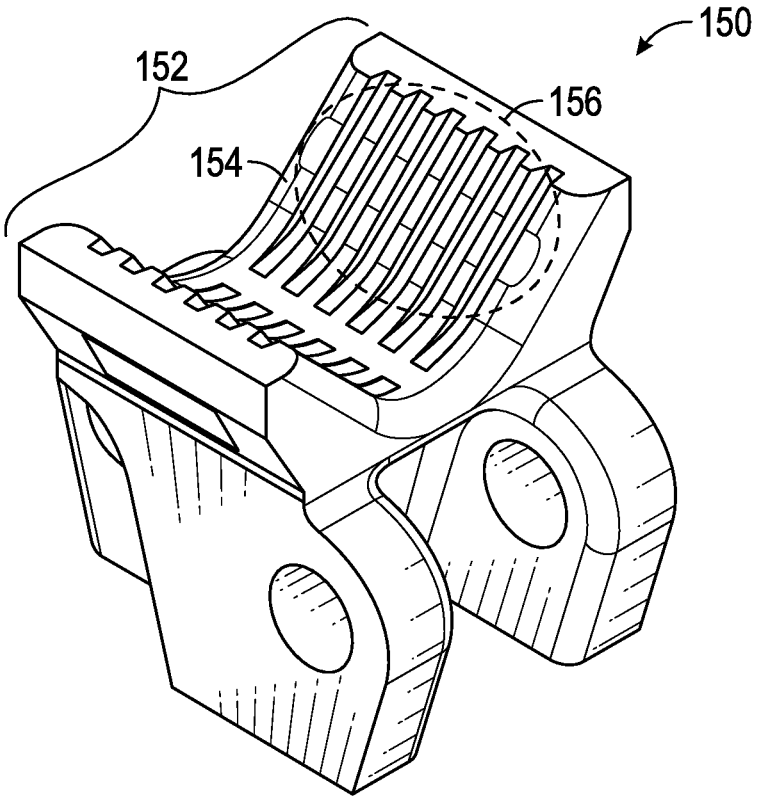
FIG. 3C is a schematic view of the flat face v-shaped gripper block of FIG. 3A showing wear.

Typical gripper blocks include a flat face v-shape or a cylindrical shape gripping portion, where the cylindrical shape matches the radius of the tubing to be injected. For example, a gripper block 150 having a gripping region 152 with a flat face v-shaped profile 154 is shown in FIGS. 3A-3C. Such flat face v-shaped gripper blocks 150 are typically used with coiled tubing injections and allow for only point contact between the tubing 104 being injected and the flat face v-shaped profile 154, as shown in FIG. 3B. As such, the flat face v-shaped gripper block 150 provides minimal contact between the gripper block 150 and the tubing 104. This contact can be insufficient for many operations and can cause tubing slippage during injection and removal. Slippage can cause damage and reduce the useful life of the tubing. A simulation was performed on each of the gripper blocks 130, 150 in which the gripper blocks 130, 150 were subjected to 0.02 inches of wear 142, 156. The resulting gripper block 130, 150 wear 142, 156 is illustrated in FIGS. 2D and 3C, respectively. For the purposes of the simulation, the wear was simulated using a coiled tubing having a diameter of 2.625 inches. The amount of contact between the gripper blocks 130, 150 and the tubing 104 are shown in Table 1.

TABLE 1

| | Contact Cord Length (inch) | Contact Arc Length (inch) | Contact Width (inch) |
|---|---|---|---|
| Radial/curved v-shaped gripper block 130 | 0.650 | 0.657 | 0.657 |
| Flat face v-shaped gripper block 150 | 0.384 | 0.386 | 0.386 |

As illustrated in FIG. 2D, the radial/curved v-shaped gripper block 130 provides about 70% greater contact area after the simulated wear 142 than the flat faced v-shaped gripper block 150 of FIG. 3C.

Figure 4A:
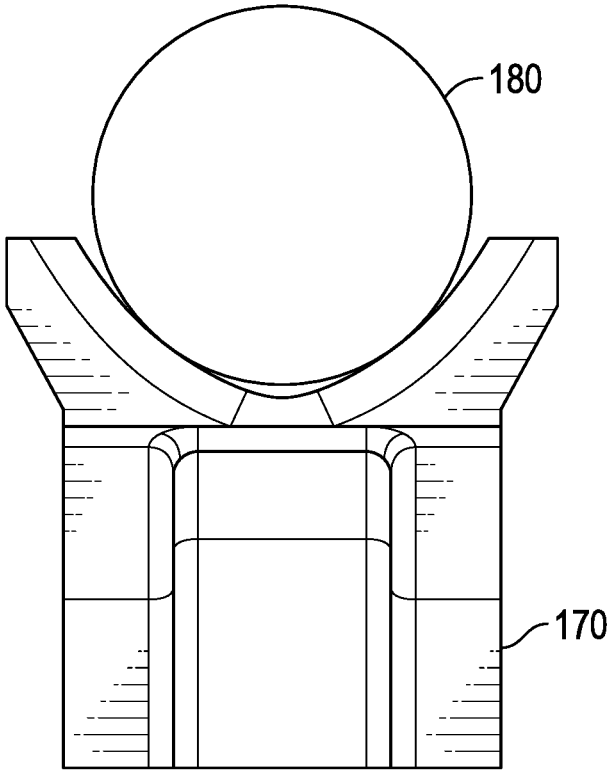
FIG. 4A is a cross-sectional view of the contact area between an exemplary radial/curved face v-shaped gripper block having a tubing coupled therewith.
Figure 4B:
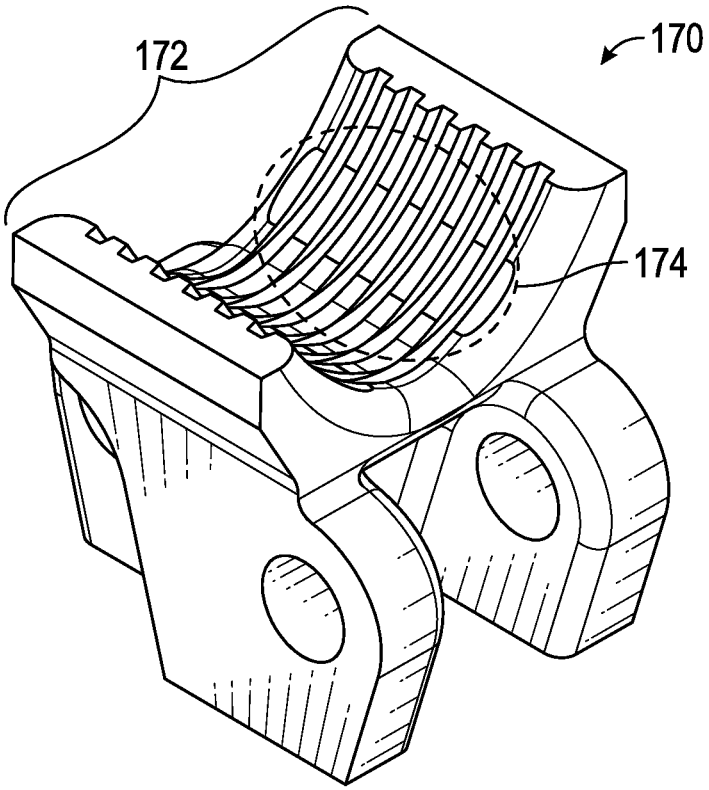
FIG. 4B is a schematic view of the exemplary radial/curved face v-shaped gripper block of FIG. 4A showing wear.
Figure 4C:
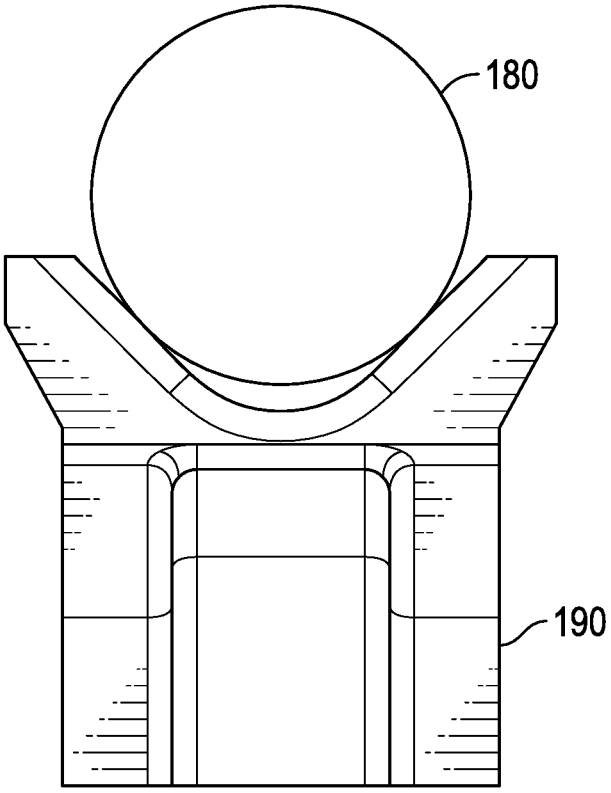
FIG. 4C is a cross-sectional view of the contact area between a flat face v-shaped gripper block having a tubing coupled therewith.

A second example illustrating the difference in the contact area between the radial/curved v-shaped gripper block and the flat face v-shaped gripper block and a tubing is illustrated in FIGS. 4A-C. Specifically, FIG. 4A illustrates an exemplary radial/curve v-shaped gripper block 170 having a tubing 180 secured within the gripping region of the gripper block 170. FIG. 4B illustrates the exemplary radial/curve v-shaped gripper block 170 of FIG. 4A having wear 174 on the gripping region 172. FIG. 4C illustrates a flat face v-shaped gripper block 190 having a tubing 180 secured within the gripping region of the gripper block 190. For the present example, the tubing 180 is a coiled tubing having a diameter of 2.375 inches. A simulation was run to provide 0.02 inch deep wear 174 on each of the gripper blocks 170, 190. After the simulation the contact area between the gripper blocks 170, 190 and the tubing 180 were as shown in Table 2, below.

TABLE 2

| | Contact Cord Length (inch) | Contact Arc Length (inch) | Contact width (inch) |
|---|---|---|---|
| Radial/curved v-shaped gripper block 130 | 0.604 | 0.611 | 0.611 |

TABLE 2-continued

| | Contact Cord Length (inch) | Contact Arc Length (inch) | Contact width (inch) |
|---|---|---|---|
| Flat face v-shaped gripper block 150 | 0.365 | 0.367 | 0.367 |

As indicated in the table, as well as FIG. 4B, the contact width is increased by about 66 percent, indicated as wear 174, when the radial/curved v-shaped gripper block 170 is used.

It should be noted that gripper blocks having a cylindrical shaped gripping region can only be used with a single size of coiled tubing. On the contrary, as stated above, the presently described radial/curved v-shaped gripping region can be used with multiple sizes of coiled tubing due to shape and position being optimized to maximize contact area as outlined in the simulations above. The described gripper block can be used to inject tubing having more than one diameter throughout the length of the tubing. For example, if a tubing string has a first diameter of 2.375 and a second diameter of 2.625, the radial/curved v-shaped gripper region of the described gripper block can be used to inject both sections of tubing without having to change out the gripper blocks on the injection machine. In an alternative, the gripper block having a radial/curved v-shape gripping region can be further optimized in curvature and radius if the gripper block is to be used with a tubing having a consistent diameter. For example, the profile of the gripping region can be adjusted such that the radii of the gripping region is closer to the unique tubing size for a specific application. The adjustment in radii can provide a wider contact path for the tubing after slight tubing deformation from gripping force.

It should be noted that while FIGS. 2C, 3B, 4A, and 4B generally depict gripper blocks 130, 150, 170, 190 having a coiled tubing 160, 180 secured therein, those skilled in the art would readily recognize that the principles described herein are equally applicable to any type of tubing string including, but not limited to, a casing, a drill string, a coiled tubing, production tubing, and the like, without departing from the scope of the disclosure.

Numerous examples are provided herein to enhance understanding of the present disclosure. A specific set of statements are provided as follows.

Statement 1: A gripper block comprising a gripping region having a gripping surface, the gripping surface having a radial/curved v-shape; and a block body positioned adjacent to the gripping region and configured to couple a gripper chain.

Statement 2: A gripper block in accordance with Statement 1, wherein the gripping surface further comprises a plurality of grooves and ridges.

Statement 3: A gripper block in accordance with Statement 1 or Statement 2, wherein the gripping region engages a tubing, the gripping region having a radius of curvature that is larger than the radius of the tubing and offset from gripper block centerline.

Statement 4: A gripper block in accordance with Statements 1-3, wherein a contact area between the gripping region and the tubing increases as a result of tubing deformation from gripper force and gripper block wear.

Statement 5: A gripper block in accordance with Statements 1-4, wherein the center of profile radii is adjusted to make the initial contact point of the tubing is centered in gripper surface.

Statement 6: A gripper block in accordance with Statements 1-5, wherein the distance from a top of the gripper block to a center of the gripping surface is adjusted such that the distance is greater than a radius of the tubing.

Statement 7: A gripper block in accordance with Statements 1-6, wherein the gripper chain includes a plurality of gripper blocks.

Statement 8: A gripper block in accordance with Statements 1-7, wherein the tubing is a coiled tubing, a pipe, a rod, a cable, or the like.

Statement 9: A gripper block in accordance with Statements 1-8, wherein the tubing is the coiled tubing.

Statement 10: A gripper block in accordance with Statements 1-9, wherein the tubing has a consistent diameter throughout its length.

Statement 11: A gripper block in accordance with Statements 1-10, wherein the tubing has a varying diameter throughout its length.

Statement 12: A system for injecting a tubing into a wellbore, the system comprising a length of tubing; and an injector apparatus for disposing the length of tubing within a wellbore, the injector apparatus including a pair of gripper chains, each gripper chain having a plurality of gripper blocks coupled therewith, each of the plurality of gripper blocks comprising a gripping region having a gripping surface thereon, the gripping surface having a radical/curved v-shape, and a block body positioned adjacent to the gripping region and configured to couple the gripper chain.

Statement 13: A system in accordance with Statement 12, wherein the gripping surface further comprises a plurality of grooves and ridges.

Statement 14: A system in accordance with Statement 12 or Statement 13, wherein the gripping region engages an outer surface of the length of tubing creating a contact area.

Statement 15: A system in accordance with Statements 12-14, wherein the length of tubing has a consistent radius.

Statement 16: A system in accordance with Statements 12-15, wherein the gripping region of the gripping block has a radius of curvature that is larger than the radius of the length of tubing.

Statement 17: A system in accordance with Statements 12-14, wherein the length of tubing includes a first portion having a first radius and a second portion having a second radius Statement 18: A system in accordance with Statements 12-17, wherein the gripping region of the gripping block has a radius of curvature that is larger than the first radius and the second radius of the length of tubing.

Statement 19: A system in accordance with Statements 12-18, wherein the contact area between the gripping region and the outer surface of the length of tubing increases as a result of tubing deformation from gripper force and gripper block wear.

Statement 20: A system in accordance with Statements 12-19, wherein the pair of gripper chains of the injector assembly are arranged so that the plurality of gripper blocks are disposed on either side of the length of tubing.

Statement 21: A system in accordance with Statements 12-20, wherein the center of profile radii of the gripper block is adjusted to make the initial contact point of the tubing is centered in gripper surface.

Statement 22: A system in accordance with Statements 12-21, wherein the distance from a top of the gripper block to a center of the gripping surface is adjusted such that the distance is greater than a radius of the tubing.

Statement 23: A system in accordance with Statements 12-22, wherein the tubing is a coiled tubing, a pipe, a rod, a cable, or the like.

Statement 24: A system in accordance with Statements 12-23, wherein the tubing is the coiled tubing.

Statement 25: A radial/curved v-shaped gripper block comprising a gripping region having an upper end and a lower end, the gripping region having a radial/curved v-shaped profile; a gripping surface disposed on and extending from the lower end of the gripping region to the upper end of the gripping region, the gripping surface having a plurality of grooves and ridges disposed thereon; and a block body located adjacent the lower end of the gripping region, the block body having one or more coupling regions therein.

Statement 26: A radial/curved v-shaped gripper block in accordance with Statement 25, wherein the radial/curved v-shaped profile of the gripping region has a profile radii R.

Statement 27: A radial/curved v-shaped gripper block in accordance with Statement 25 or 26, wherein the profile radii of the gripping region can be adjusted in an X direction based on a tubing size to be gripped.

Statement 28: A radial/curved v-shaped gripper block in accordance with Statements 25-27, wherein the height of the gripping region can be adjusted based on a tubing size to be gripped.

Statement 29: A radial/curved v-shaped gripper block in accordance with Statements 25-28, wherein the profile radii of the gripping region is greater than the radius of a tubing to be gripped.

Statement 30: A radial/curved v-shaped gripper block in accordance with Statements 25-29, wherein the plurality of grooves and ridges are made of a material which can be worn down.

Statement 31: A radial/curved v-shaped gripper block in accordance with Statements 25-30, wherein a contact area between the gripping region and a tubing increases as a result of tubing deformation.

Statement 32: A radial/curved v-shaped gripper block in accordance with Statements 25-31, wherein the gripping region engages a tubing.

Statement 33: A radial/curved v-shaped gripper block in accordance with Statements 25-32, wherein a contact area between the gripping region and the tubing increases as a result of tubing deformation from gripper force and gripper block wear.

Statement 34: A radial/curved v-shaped gripper block in accordance with Statements 25-33, wherein the block body can be coupled to one or more radial/curved v-shaped gripper blocks via the coupling regions thereon.

Statement 35: A radial/curved v-shaped gripper block in accordance with Statements 25-34, wherein the one or more coupled radial/curved v-shaped gripper blocks form a gripper chain.

Statement 36: A radial/curved v-shaped gripper block in accordance with Statements 25-35, wherein the tubing is a coiled tubing, a pipe, a rod, a cable, or the like.

Statement 37: A radial/curved v-shaped gripper block in accordance with Statements 25-36, wherein the tubing has a consistent diameter throughout its length.

Statement 38: A radial/curved v-shaped gripper block in accordance with Statements 25-37, wherein the tubing has a varying diameter throughout its length.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

I claim:

1. A gripper block comprising:

a gripping region having two gripping surfaces, wherein the two gripping surfaces are curved and arranged in a v-shape such that when the gripping region is engaging a tubing, the tubing only contacts the two gripping surfaces, wherein each of the two gripping surfaces has a single radius of curvature that is larger than a radius of the tubing, and wherein each of the two gripping surfaces has a center of curvature that is horizontally offset from a vertical centerline of the gripper block; and a block body positioned adjacent to the gripping region and configured to couple to a gripper chain.

2. The gripper block of claim 1, wherein each of the two gripping surfaces further comprises a plurality of grooves and ridges.

3. The gripper block of claim 1, wherein a contact area between the gripping region and the tubing increases as a result of tubing deformation from gripper force and gripper block wear.

4. A system for injecting a tubing into a wellbore, the system comprising:

a length of tubing; and an injector apparatus for disposing the length of tubing within a wellbore, the injector apparatus including a pair of gripper chains, each gripper chain having a plurality of gripper blocks coupled therewith, each of the plurality of gripper blocks comprising:

a gripping region having two gripping surfaces thereon, wherein the two gripping surfaces are curved and arranged in a v-shape, such that when the gripping region is engaging the length of tubing, the length of tubing only contacts the two gripping surfaces, wherein each of the two gripping surfaces has a single radius of curvature that is larger than a radius of the tubing, and wherein each of the two gripping surfaces has a center of curvature that is horizontally offset from a vertical centerline of the gripper block, and a block body positioned adjacent to the gripping region and configured to couple to gripper chain.

5. The system of claim 4, wherein each of the two gripping surfaces further comprises a plurality of grooves and ridges.

6. The system of claim 4, wherein the gripping region engages an outer surface of the length of tubing creating a contact area.

7. The system of claim 6, wherein the length of tubing has a consistent radius.

8. The system of claim 6, wherein the length of tubing includes a first portion having a first radius and a second portion having a second radius.

9. The system of claim 8, wherein the gripping region of the gripper block has a radius of curvature that is larger than the first radius and the second radius of the length of tubing.

10. The system of claim 6, wherein the contact area between the gripping region and the outer surface of the length of tubing increases as a result of tubing deformation from gripper force and gripper block wear.

11. The system of claim 4, wherein the pair of gripper chains of the injector apparatus are arranged so that the plurality of gripper blocks are disposed on either side of the length of tubing.

12. A radial/curved v-shaped gripper block comprising:

a gripping region having an upper end and a lower end, the gripping region having a radial/curved v-shaped profile;

two gripping surfaces disposed on and extending from the lower end of the gripping region to the upper end of the gripping region, each gripping surface having a plurality of grooves and ridges disposed thereon, wherein, when the gripping region is engaging a tubing, the tubing only contacts the two gripping surfaces, wherein each of the two gripping surfaces has a single radius of curvature that is larger than a radius of the tubing, and wherein each of the two gripping surfaces has a center of curvature that is horizontally offset from a vertical centerline of the gripper block; and a block body located adjacent the lower end of the gripping region, the block body having one or more coupling regions therein.

13. The radial/curved v-shaped gripper block of claim 12, wherein the radial/curved v-shaped profile of the gripping region has a profile radii R.

14. The radial/curved v-shaped gripper block of claim 13, wherein the profile radii of the gripping region can be adjusted in an X direction based on a tubing size to be gripped.

15. The radial/curved v-shaped gripper block of claim 13, wherein the height of the gripping region can be adjusted based on a tubing size to be gripped.

16. The radial/curved v-shaped gripper block of claim 13, wherein the profile radii of the gripping region is greater than the radius of a tubing to be gripped.

17. The radial/curved v-shaped gripper block of claim 12, wherein the plurality of grooves and ridges are made of a material which can be worn down.

18. The radial/curved v-shaped gripper block of claim 12, wherein a contact area between the gripping region and a tubing increases as a result of tubing deformation.

* * * * *